US006903521B2

(12) United States Patent
Park

(10) Patent No.: US 6,903,521 B2
(45) Date of Patent: Jun. 7, 2005

(54) ELECTROMAGNETIC INDUCED ACCELERATOR

(75) Inventor: Won-taek Park, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/734,121

(22) Filed: Dec. 15, 2003

(65) Prior Publication Data

US 2004/0124793 A1 Jul. 1, 2004

(30) Foreign Application Priority Data

Dec. 14, 2002 (KR) ..... 10-2002-0080062

(51) Int. Cl.[7] ..... H05H 7/00

(52) U.S. Cl. ..... 315/506; 315/501; 315/500; 313/359.1

(58) Field of Search ..... 315/506, 501, 315/500, 505, 502; 313/359.1, 362.1

(56) References Cited

U.S. PATENT DOCUMENTS 5,509,266 A * 4/1996 Morozov et al. ..... 60/203.1
5,847,593 A 12/1998 Pernyeszi ..... 327/432
5,945,781 A * 8/1999 Valentian ..... 315/111.81
6,456,011 B1 * 9/2002 Bugrova et al. ..... 315/111.91

OTHER PUBLICATIONS

Scheuer et al, "A Magnetically–Nozzled, Quasi–" IEEE Trans. Plasma Science, 22(6):1015–1033 (Dec. 1994).

* cited by examiner

*Primary Examiner*—Tuyet Thi Vo
(74) *Attorney, Agent, or Firm*—Lee, Sterba & Morse, P.C.

(57) ABSTRACT

An electromagnetic induced accelerator includes internal and external circular loop inductors for inducing a magnetic field when a current is applied to the internal and external circular loop inductors in a same direction, the internal and external circular loop inductors being spaced apart from each other by a predetermined distance and disposed coaxially and parallel to each other; a channel, which includes dielectric layers contacting the internal and external circular loop inductors, disposed between the internal and external circular loop inductors, wherein a secondary current is induced in the channel between the dielectric layers by the induced, magnetic field; and a discharging coil for supplying a pulse energy to the channel and for generating a plasma.

8 Claims, 3 Drawing Sheets

ELECTROMAGNETIC INDUCED ACCELERATOR

BACKGROUND OF THE INVENTION

1. Field of the Invention

The present invention relates to a plasma accelerator. More particularly, the present invention relates to an electromagnetic induced plasma accelerator.

2. Description of the Related Art

As demands on a high-speed microprocessor and a high recording density memory increase, a technique for reducing the thickness of a gate dielectric and a lateral size of a logic device are being developed to increase the number of devices that are able to be mounted on a single semiconductor chip. In particular, a technique by which a gate length of a transistor may be reduced to 35 mm or less, a thickness of a gate oxide layer may be reduced to 0.5 nm or less, and a metalization level may be increased to 6 or more, has been intensely studied. In order to embody this technique, a high-performance etch technique and a pattern transfer technique are needed during the semiconductor chip manufacturing process. Thus, an etch technique using a plasma accelerator becomes increasingly important.

FIG. 1 illustrates a cut-away bottom, perspective view schematically showing the structure of a conventional plasma accelerator. Referring to FIG. 1, the conventional accelerator includes a circular channel 22 having a closed upper end and an open lower end, an internal circular coil 16 and a plurality of external circular coils 17, 18, 18', and 19. Each of the internal circular coil 16 and the external circular coils 17, 18, 18', and 19 are disposed coaxially in an X-direction and parallel to an inside and an outside of the channel 22, respectively, and collectively form a magnetic field with a magnetic pole divided physically and magnetically. The accelerator additionally includes a circular anode 24 to which a gas supply pipe 25 is connected and which ionizes a gas, and a cathode 27, which is disposed on a magnetic pole at a lower end of the channel 22, that is connected to a gas supply line 29 and supplies electrons.

The external coils 17, 18, 18', and 19 are divided into an upper coil 17, which surrounds the outside of the channel 22, and lower coils 18, 18', and 19 having divided sections, which surround an opening of the channel 22. Upper portions of the upper coil 17 and the internal coil 16 are partitioned by a dielectric layer 23, and a magnetic field of the upper portions is shielded. Thus, a partial magnetic field across a spatial portion 20 of the channel 22 is induced only in an opening 22A. A magnetic field formed in a portion where the lower coils 18, 18', and 19 are disposed, partially captures electrons. As a result, only positive ions can be accelerated, thus plasma having an electrically neutral characteristic cannot be accelerated by an electric field formed by the anode 24 and the cathode 27. In addition, in the above conventional accelerator, electrons are accumulated on a surface of a substrate on which ions are to be deposited, and thus, losses, such as a charge short occur there. In addition, notching occurs in a fine pattern, thereby causing an etch profile to be nonuniform.

FIG. 2 illustrates a cross-sectional view schematically showing the structure of another conventional plasma accelerator. Referring to FIG. 2, this coaxial plasma accelerator includes a circular channel 50 having a closed upper end and an open lower end, wherein plasma generated when a gas is discharged is accelerated, a cylindrical cathode 54 disposed inside the circular channel 50, a cylindrical anode 52, which is spaced apart from the cylindrical cathode 54 by a predetermined distance, and is disposed coaxially and parallel to the outside of an opening of the channel 50, a control coil 64, which controls plasma in the circular channel 50, a cathode coil 56 disposed inside the cylindrical cathode 54, an anode coil 58 disposed outside the cylindrical anode 52, and a magnetic inductor 70 that induces a magnetic field to the opening of the circular channel 50 by flowing current through the cathode and anode coils 56 and 66. A gas feed 62 and an insulator 66 are additionally illustrated.

In the above conventional accelerator, the circular channel 50 has inner and outer walls where the cylindrical cathode 54 and the cylindrical anode 52 are provided, respectively. In addition, the control coil 64 is disposed outside the circular channel 50. As such, current across the circular channel 50 is formed in the accelerator, and a magnetic field is induced in a radial direction that surrounds the cylindrical cathode 54 by the current. An example of this accelerator is a plasma accelerator mounted in a spaceship manufactured by Los Alamos National Laboratory.

The speed of the plasma ions accelerated by the accelerator represents a hypermagnetic sound velocity of about 500 eV. Thus, the plasma ions, accelerated in the circular channel 50 from the cylindrical anode 52 to the cylindrical cathode 54, are collided with the cylindrical cathode 54 such that the degree of damage to the cylindrical cathode 54 is severe and the plasma ions cannot be readily used in an etch process for a semiconductor thin-layer deposition process.

SUMMARY OF THE INVENTION

The present invention provides an accelerator for accelerating plasma ions having a neutral characteristic capable of performing a semiconductor thin-layer deposition process with high anisotropy, high selectivity, good formation of uniform layers, and high process reproducibility.

According to an aspect of the present invention, there is provided an electromagnetic induced accelerator including internal and external circular loop inductors for inducing a magnetic field when a current is applied to the internal and external circular loop inductors in a same direction, the internal and external circular loop inductors being spaced apart from each other by a predetermined distance and disposed coaxially and parallel to each other; a channel, which includes dielectric layers contacting the internal and external circular loop inductors, disposed between the internal and external circular loop inductors, wherein a secondary current is induced in the channel between the dielectric layers by the induced, magnetic field; and a discharging coil for supplying a pulse energy to the channel and for generating a plasma. In the electromagnetic induced accelerator, the induced, magnetic field may be reduced in an axial direction.

Preferably, the induced, magnetic field is reduced in an axial direction by reducing a number of windings of coils wound in the internal and external circular loop inductors in the axial direction or by reducing the current applied to the internal and external circular loop inductors.

Preferably, the induced, magnetic field is formed orthogonal to the axial direction and across the channel. Preferably, the secondary current is formed in a direction to surround the internal circular loop inductor.

Preferably, a speed of plasma ions is about 500 eV or less. In addition, the electromagnetic induced accelerator may further include a magnetic fluctuation probe, a Langmuir probe, or a speed indicator for measuring a speed of plasma ions.

Accordingly, the present invention provides an electromagnetic induced accelerator for accelerating plasma having a neutral characteristic and having a high flux density using an induction field and current, instead of using an electrostatic force using an electric field by electron accumulation as in a conventional accelerator.

BRIEF DESCRIPTION OF THE DRAWINGS

The above and other aspects and advantages of the present invention will become more apparent to those of ordinary skill in the art by describing in detail a preferred embodiment thereof with reference to the attached drawings in which.

DETAILED DESCRIPTION OF THE INVENTION

Figure 1:
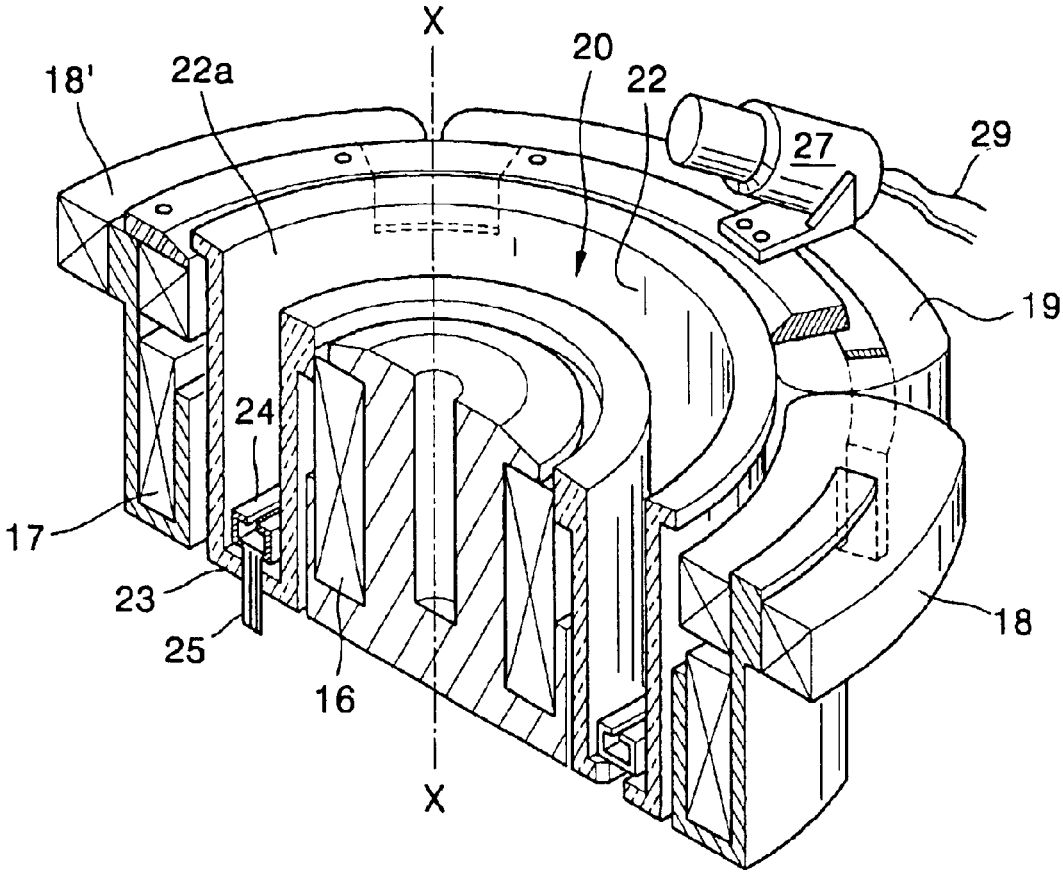
FIG. 1 (PRIOR ART)
FIG. 1 illustrates a cut-away bottom, perspective view schematically showing the structure of a conventional plasma accelerator.
Figure 2:
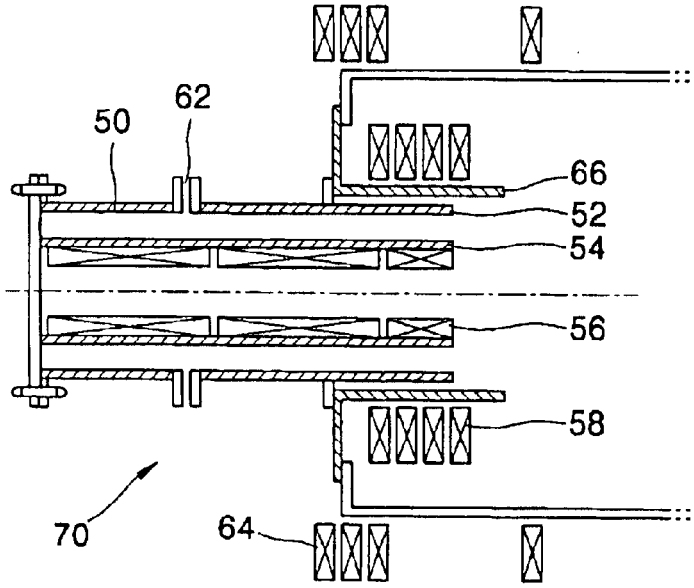
FIG. 2 (PRIOR ART)
FIG. 2 illustrates a cross-sectional view schematically showing the structure of another conventional plasma accelerator.

Korean Patent Application No. 2002–80062, filed on Dec. 14, 2002, and entitled: "Electromagnetic Induced Accelerator," is incorporated by reference herein in its entirety.

The present invention will now be described more fully hereinafter with reference to the accompanying drawings, in which a preferred embodiment of the invention is shown. The invention may, however, be embodied in different forms and should not be construed as limited to the embodiments set forth herein. Rather, this embodiment is provided so that this disclosure will be thorough and complete, and will fully convey the scope of the invention to those skilled in the art. In the drawings, the thickness of layers and regions are exaggerated for clarity. Like numbers refer to like elements throughout.

Figure 3:
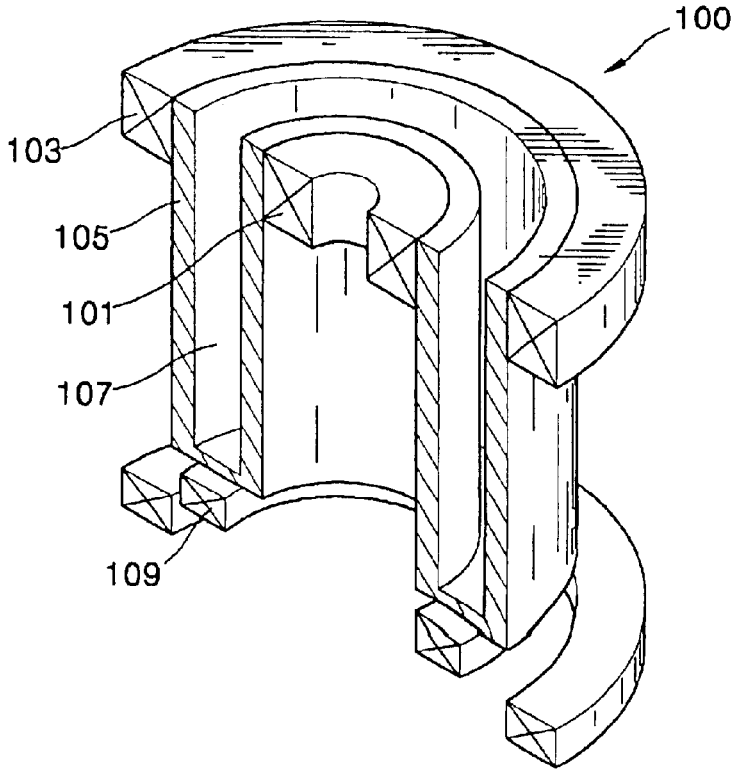
FIG. 3 illustrates a cut-away perspective view schematically showing an electromagnetic induced accelerator according to a preferred embodiment of the present invention.

FIG. 3 illustrates a cut-away perspective view schematically showing an electromagnetic induced accelerator according to a preferred embodiment of the present invention. Referring to FIG. 3, an electromagnetic induced accelerator 100 includes internal and external circular loop inductors 101 and 103, a channel 107 disposed adjacent to and between the internal and external circular loop inductors 101 and 103, a dielectric layer 105 disposed between the internal and external circular loop inductors 101 and 103 and forming the channel 107, and a discharging coil 109 disposed on a bottom of the channel 107.

The internal and external loop inductors 101 and 103 are disposed coaxially and parallel to each other, and a current is applied to the internal and external loop inductors 101 and 103 in a radial direction surrounding the channel 107. The current may be applied to the internal and external loop inductors 101 and 103 clockwise or counterclockwise, thereby inducing a magnetic field across the inside of the channel 107.

In order to reduce a magnetic field induced inside the channel 107 in the axial direction, either the density of windings of coils wound in the internal and external loop inductors 101 and 103 may be reduced in an axial direction, or the current flowing through the coils wound by the density of windings may be reduced. The magnetic field is formed to be perpendicular to a direction of the windings of the coils and across the channel 107 and is gradually reduced in the axial direction.

In an exemplary accelerator according to an embodiment of the present invention, the circular loop inductors 101 and 103 have a length of 10 cm and a diameter of 10 cm, a vacuum chamber has a diameter of 30 cm and a length of 100 cm, wherein the vacuum chamber has a function of turbo-molecular pumping. The exemplary accelerator additionally provides a pulse formation network connected to these devices and systems for process control based on a PC, information acquisition, and an information analysis system. Thus, an etch system is constructed. Preferably, plasma ions are accelerated so that the accelerator has a translation energy of about 500 eV, and thus, an etch rate with respect to polysilicon can be 200 Å/min or more without losses caused by electron charge.

An electric energy pulse generated in the discharging coil 109 is propagated through a gas at a high speed, thereby forming a plasma. Accordingly, an electrode is not required to be separately provided in an accelerator according to an embodiment of the present invention as in a conventional accelerator using an electrostatic force. More specifically, an electrode that physically contacts the plasma is not required to be separately provided in the accelerator of the present invention.

Figure 4:
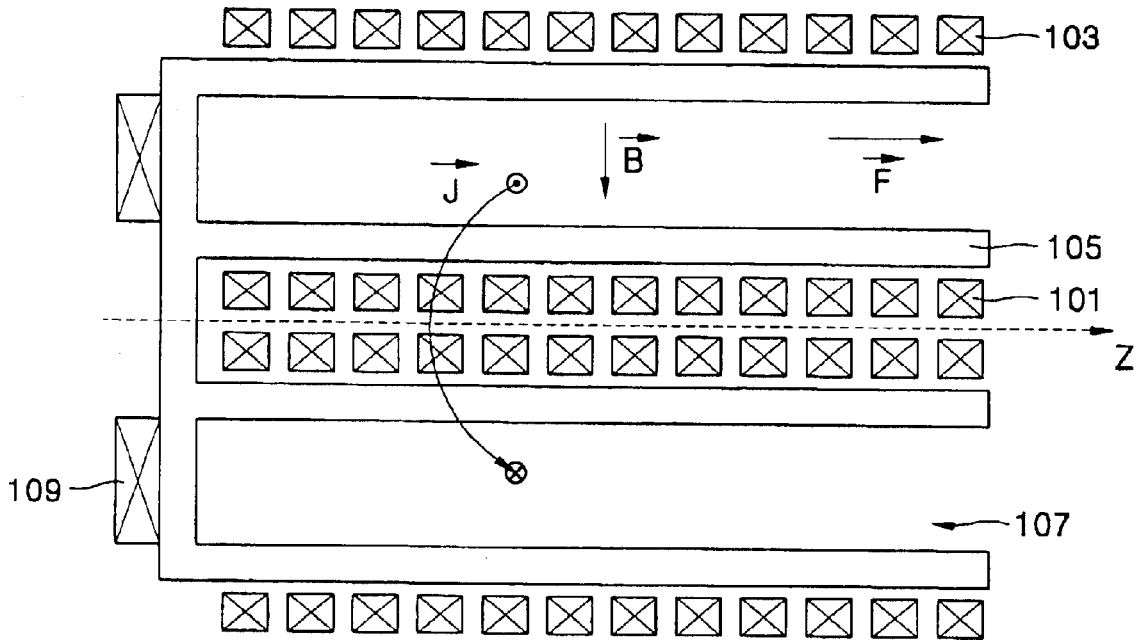
FIG. 4 illustrates a cross-sectional view schematically showing an electromagnetic induced accelerator according to the preferred embodiment of the present invention.

FIG. 4 illustrates a cross-sectional view schematically showing an electromagnetic induced accelerator according to the preferred embodiment of the present invention. FIG. 4 illustrates the induction of an induced, magnetic field $\vec{B}$ and a secondary current $\vec{J}$, as well as, the induction of an electromagnetic force $\vec{F}$ by the magnetic field $\vec{B}$ and the secondary current $\vec{J}$.

Current flowing through the internal and external circular loop inductors 101 and 103 induces a magnetic field $\vec{B}$ in the channel 107. The induced magnetic field $\vec{B}$ induces a secondary current $\vec{J}$ in accordance with Maxwell's equations. If current flowing through the internal and external circular loop inductors 101 and 103 is applied to a direction from the ground, as shown in FIG. 4, the magnetic field $\vec{B}$ is induced across the channel 107, and the secondary current $\vec{J}$ is induced counterclockwise, i.e., out of a top portion of the channel 107 and into a bottom portion of the channel 107, as illustrated in FIG. 4, where the internal circular loop inductor 101 is surrounded by the second current $\vec{J}$.

The secondary current $\vec{J}$ generates an electric field having a sufficient strength to decompose an externally-supplied gas in a plasma state. According to the equation $\vec{F} = \vec{J} \times \vec{B}$, the secondary current $\vec{J}$ and the magnetic field $\vec{B}$ form an electromagnetic force $\vec{F}$ in a Z-direction so that plasma ions are accelerated toward an outlet of the channel 107 regardless of the polarity of the ions. Plasma beams accelerated by the electromagnetic force $\vec{F}$ are formed by mixing electrons and positive ions, and thus represent electrical neutrality. That is, the accelerator according to an embodiment of the present invention accelerates ions in the same direction regardless of the polarity of the ions. Thus, the anode and the cathode, which are necessarily provided in a conventional electrostatic-type accelerator, are no longer required, thereby simplifying the structure of the accelerator according to an embodiment of the present invention.

The accelerator according to an embodiment of the present invention controls the current flowing through the internal and external circular loop inductors 101 and 103, thereby controlling the electromagnetic force $\vec{F}$. Preferably, the speed of plasma ions is limited to a magnetic subsonic speed of about 500 eV or less such that an etch profile of a target is made uniform and the uniformity of a thin layer deposited on a substrate can be improved. A magnetic fluctuation probe, a Langmuir probe, or a speed indicator may be further included to measure the speed of the plasma ions.

As described above, in the electromagnetic induced accelerator according to the present invention, coils are wound coaxially with the inside and outside of a channel wherein plasma ions are accelerated, and a current is applied to the coils in the same direction to form a magnetic field across the channel. In addition, the number of windings wound in the circular loop inductors may be reduced, or the current may be reduced so that a magnetic field that is induced in the channel may be gradually reduced in an axial direction, thereby generating an electromagnetic force by interaction between the secondary current induced by the magnetic field in the channel and an induction field. In addition, plasma formed of a discharging coil is effectively accelerated such that notching that occurs in a conventional electrostatic-type accelerator is prevented, and a semiconductor etch process with high anisotropy, high selectivity, good formation of uniform layers, and high process reproducibility can be performed.

A preferred embodiment of the present invention has been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electromagnetic induced accelerator, comprising:

internal and external circular loop inductors for inducing a magnetic field when a current is applied to the internal and external circular loop inductors in a same direction, the internal and external circular loop inductors being spaced apart from each other by a predetermined distance and disposed coaxially and parallel to each other;

a channel, which includes dielectric layers contacting the internal and external circular loop inductors, disposed between the internal and external circular loop inductors, wherein a secondary current is induced in the channel between the dielectric layers by the induced, magnetic field; and a discharging coil for supplying a pulse energy to the channel and for generating a plasma.

2. The accelerator as claimed in claim 1, wherein the induced, magnetic field is reduced in an axial direction.

3. The accelerator as claimed in claim 2, wherein the induced, magnetic field is reduced in an axial direction by reducing a number of windings of coils wound in the internal and external circular loop inductors in the axial direction.

4. The accelerator as claimed in claim 2, wherein the induced, magnetic field is reduced in an axial direction by reducing the current applied to the internal and external circular loop inductors.

5. The accelerator as claimed in claim 1, wherein the induced, magnetic field is formed orthogonal to the axial direction and across the channel.

6. The accelerator as claimed in claim 1, wherein the secondary current is formed in a direction to surround the internal circular loop inductor.

7. The accelerator as claimed in claim 1, wherein a speed of plasma ions is about 500 eV or less.

8. The accelerator as claimed in claim 1, further comprising:

a device for measuring a speed of plasma ions, the device being selected from the group consisting of a magnetic fluctuation probe, a Langmuir probe, and a speed indicator.

* * * * *